US007441378B2

(12) United States Patent
Wood

(10) Patent No.: US 7,441,378 B2
(45) Date of Patent: Oct. 28, 2008

(54) DECK PLANK COVER

(76) Inventor: Kevin William Wood, 28861 Tawas, Madison Heights, MI (US) 48071

( * ) Notice: Subject to any disclaimer, the term of this patent is extended or adjusted under 35 U.S.C. 154(b) by 361 days.

(21) Appl. No.: 10/769,711

(22) Filed: Feb. 2, 2004

(65) Prior Publication Data

US 2005/0178071 A1 Aug. 18, 2005

(51) Int. Cl.
*E04F 11/16* (2006.01)
*E04F 11/00* (2006.01)
*E04C 1/00* (2006.01)

(52) U.S. Cl. ..... 52/177; 52/182; 52/309.14

(58) Field of Classification Search ..... 52/177, 52/309.14, 309.15, 650.3, 58, 60, 179, 180, 52/181, 6, 3, 730.1
See application file for complete search history.

(56) References Cited

U.S. PATENT DOCUMENTS 3,093,216 A * 6/1963 Dunham ..... 52/180
3,353,867 A * 11/1967 Anderson ..... 297/228.13
4,003,177 A * 1/1977 de la Concha ..... 52/630
4,198,795 A * 4/1980 Barnidge ..... 52/180
4,907,387 A * 3/1990 Turnbull ..... 52/177
5,351,458 A * 10/1994 Lehe ..... 52/586.2
5,505,517 A * 4/1996 Groh et al. ..... 297/219.1
6,427,395 B1 * 8/2002 Elsasser et al. ..... 52/181
7,007,437 B2 * 3/2006 Thomas ..... 52/650.3
D519,430 S * 4/2006 Moody ..... D12/203

* cited by examiner

*Primary Examiner*—Richard E. Chilcot, Jr.
*Assistant Examiner*—Jessica Laux
(74) *Attorney, Agent, or Firm*—David W. Schumaker

(57) ABSTRACT

A deck plank cover made from a plastic material, such as a vinyl or HDPE or Wood composite, wherein the deck plank cover is designed to be affixed to the top surface of a preexisting deck plank. The deck plank cover is useful for repairing or protecting mildly deteriorated or deteriorating wooden deck planks of typical wooden decks. The deck plank cover may be affixed directly to the top surface of the existing wooden deck planks, and serves to substantially protect the wooden deck planks from further exposure to the elements. The deck plank cover uses inwardly angled side portions and wood engaging fillets to adhere to the deck planks without the need for screws, nails, or adhesives.

20 Claims, 3 Drawing Sheets

DECK PLANK COVER

FIELD OF THE INVENTION

The present invention relates generally to decks, and more particularly to a protective deck plank cover. Specifically the present invention relates to a protective deck plank cover which has features which allow the cover to cling to and provide protection from the elements for the deck plank.

BACKGROUND OF THE INVENTION

A common problem exists with decks of typical wooden construction. When a deck surface is constructed of wood, it is subject to rotting, warping, splintering, discoloration, deterioration and other tendencies inherent to the wood itself. Therefore, wooden decks must generally be frequently treated with a chemical preservative to help the wood withstand the effects of exposure to an outdoor atmosphere. Such treatment is usually very time consuming, costly and laborious, and typically must be repeated frequently. Additionally, even with proper treatment, there is no guarantee that the wood will not deteriorate. There are a number of reasons for this, including moisture present in the wood prior to treatment, areas of the wood which are difficult to access during treatment, and entry ways into the wood, such as nail holes, which allow moisture to intrude. Furthermore, the wood may also be damaged by temperature fluctuations leading to expansion and contraction, and by exposure to ultraviolet radiation via sunlight.

Once a wooden deck has begun to deteriorate there is generally little that can be done to halt the process. The typical solution is to remove and replace the wooden boards once they reach a point where their appearance can no longer be tolerated or they become unsafe. Replacement of boards is not only costly, but can also be difficult depending on the construction of the deck and the particular location of the damaged board. In addition, deteriorating boards can prove a danger, as they often produce splinters, result in an uneven walking surface. Also, the deterioration may occur from within causing the deck to become structurally unstable without appearing as such from the outside.

Many decks are being built now with composite or plastic planks which are either solid or cored. These products eliminate the problems of long term care of wooden decks, yet the cost is prohibitive as it is 2 to 3 times the cost of wood. Thus it would be highly desirous, to have a lower cost alternative to such plastic planks. Such an alternative would be to cover the surface of the planks of a wooden deck, whether or not it has already begun to show signs of deterioration, with an aesthetically pleasing and stable surface.

Early attempts at such a cover are disclosed in U.S. Pat. No. 4,885,882 (the '882 patent) to Forshee issued on Dec. 12, 1989 entitled "Deck Covering" and U.S. Pat. No. 4,907,387 (the '387 patent) to Turnbull issued Mar. 13, 1990 and entitled "Patio Deck Sheath", the disclosures of which are hereby incorporated by reference. These plank covers comprise a flat top portion to cover the top of the plank and two flat side portions attached perpendicularly to either edge of the flat top portion to thereby cover the sides of the plank. These covers were innovative for their time, but deficiencies in their design and construction have come to light.

One such deficiency is that the cover must be fastened to the deck plank by some sort of fastener such as glue, nails or screws, etc. This fastening causes problems. First, the thermal expansion of the wood and the plastic coverings is substantially different. Thus, the temperature differential between summer and winter will cause the glued covers to break free and those fastened by nail or screw to warp and/or bulge. Also screwing or nailing through the cover allows moisture to enter through the covering and attack the wood underneath the covering resulting in unseen deterioration and rotting.

A second deficiency of these early covers stems from the fact that such wooden deck planks are not the same size (particularly weather treated lumber) throughout their entire lifetime. When the lumber is fresh out of the mill, it is a different size than when the plank has dried for a significant amount of time. Thus, once the glue holding the cover down has broken because of the stress of thermal expansion/compression or weathering, and the deck plank has shrunk with age, the cover will not be held in place by anything and will come loose. Also, the shrinkage of the wood over time means that multiple widths of the cover will be needed to accommodate the differing sizes of wood on different age decks, making production costs prohibitively high.

A later attempt to produce a plank cover is disclosed in U.S. Pat. No. 5,070,664 (the '664 patent) to Groh, et al. issued on Dec. 10, 1991 and entitled "Thermoplastic Cover for Stadium Seating, Picnic Tables, Boat Docks and the Like", the disclosure of which is herein incorporated by reference. The cover disclosed in this patent has the same basic structure as the '882 and '387 patents, but adds "marginal flange portions" to the bottom edges of the side portions which are perpendicular to the side portions and extend partially inward toward each other. These flange portions are adapted and configured to engage the undersurface of the wooden plank.

Unfortunately this configuration while attempting to eliminate the deficiencies of the prior art, added additional deficiencies and retained others. First, in this configuration, the plank cover is deficient in that it cannot be added to existing structures. That is, because the flange portions engage the flat underside of the wooden planks, they cannot be placed onto the planks after the planks have been installed onto a deck. The covers must be placed on the wooden planks before construction of the deck. Thus, the deck fasteners (nails, screws, etc.) must be driven through the cover to construct the deck. This gives rise to the moisture leakage and thermal warping/bulging deficiencies of the prior art discussed above and once again, this cover structure does nothing to account for the shrinkage of the wood as it ages. Finally the cover structure must be cut/notched to accommodate joists, ledgers and other supporting structure to which the cover planks will be attached, thus complicating installation and construction.

Finally, a very recent attempt to design a deck plank cover is disclosed in U.S. Patent Application Publication 2002/0023395 (the '395 publication) A1 to Pasterchick, published Feb. 28, 2002 and entitled "Deck Master", the disclosure of which is incorporated herein by reference. The cover has the same basic structure as the '882 and '387 patents, but adds locking tabs to anchor the cover to the under side of the wooden plank. These locking tabs seem to be very similar to the flange portions of the '664 patent and are adapted and configured to engage the undersurface of the wooden plank. Again, it seems that this configuration would require the covers to be placed on the wooden planks before construction of the deck. However, if not the cover structure must still be cut/notched to accommodate ledgers, joists and other supporting structure to which the cover planks will be attached, thus complicating installation and construction. Additionally, this cover design seems to have side panels that do not extend all the way down the edges of the wooden plank and therefore leave a portion of the wood exposed to the elements to deteriorate/rot. Finally, as with all of the previous designs, this cover design does nothing to account for the shrinkage of the wood as it ages.

Thus there is a need for a deck plank cover that can be applied over the planks of a new or existing wooden deck after construction thereby giving the benefits of a plastic or composite deck, for fraction of the cost. The plank cover should adhere to the wooden plank at any ambient temperature without the use of glue or fasteners and remain adherent even as the wooden plank it covers shrinks upon aging.

SUMMARY OF THE INVENTION

A protective covering for a deck plank. The deck plank has a top surface, two side surfaces, and two lower radial portions. The protective cover has a top portion which has a length and width and covers the top surface of the deck plank. The top portion also has an outer surface which is remote from the deck plank and an inner surface which is adjacent the deck plank. The protective cover also has two side portions, each of which has a length and a height and covers one of the side surfaces of the deck plank. The side portions are attached to the top portion such that the length dimension of the top portion and the side portions coincide. Both of the side portions projecting from the top portion in a direction generally opposite that of the outer surface of the top portion and at angles that deviate from perpendicular such that each of the side portions angles inward toward each other. The inward angle providing said cover with a frictional adhesion to the two side surfaces of the deck plank. The cover further includes wood engaging fillets attached to the edges of the side portions which are distant from the top portion. The fillets are designed to grip the lower radial portions of the deck plank thereby providing for additional frictional adhesion to the deck plank. The wood engaging fillets may extend the entire length of the side portions and may also include a drip edge designed to prevent water from contacting the deck plank.

The cover is preferably formed from materials such as a plastic/wood composite, polyethylene, polyvinyl chloride, polypropylene and mixtures or composites thereof. The outer surface of the top portion of the cover may include a texture on at least a portion thereof which may have the purpose of increasing the coefficient of friction of the outer surface of the deck plank cover.

DETAILED DESCRIPTION OF THE INVENTION

The present invention is a plastic deck plank cover which can be applied individually over existing wooden deck planks. The deck plank cover can be applied using the inherent cohesion between the longitudinal radii of the deck plank cover bottom edges and the bottom radii of the original deck plank. The deck plank cover of the present invention can be applied to a deck at the early stages of deterioration to prolong its life, and to new decks to help prevent the onset of deterioration and eliminate the need for frequent cleaning and staining to maintain appearance.

Figure 1:
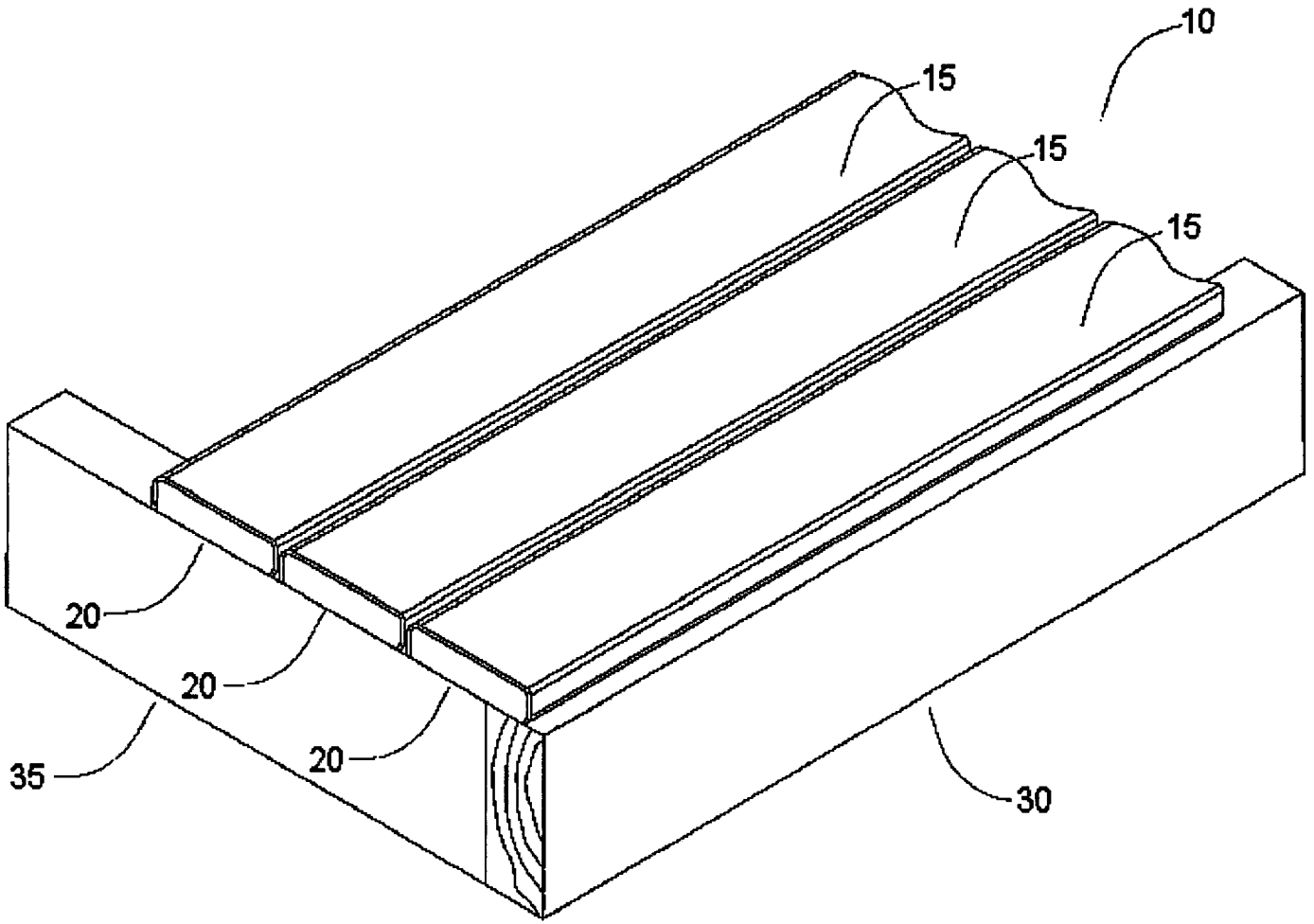
FIG. 1 is a perspective view of a preferred embodiment of the present invention installed on an existing wood deck.

FIG. 1 shows a typical wooden deck 10 with a multitude of deck plank covers 15 attached thereto. Although in this example, the deck 10 is of wood construction, it should be understood that the deck could also be of a plastic or metal construction. The deck 10 consists of a number of wooden deck planks 20 mounted to a sub-frame. The sub-frame will typically consist of a number of ledgers 30 and joists 35, to which support legs (not shown) are attached for anchoring the sub-frame to the ground. The construction of the deck 10 is shown for purposes of illustration only, and many alternate configurations are possible.

The wooden deck planks 20 may be of many common lumber sizes, such as 2"×2", 2"×4", 2"×6" or ¾"×6". Alternatively, the wooden deck planks may also be of a non-standard width. The deck plank covers 15 should preferably be substantially the same width as the wooden deck planks 20, to facilitate complete coverage of the top surface of the wooden deck planks by the deck plank covers. It can be seen by reference to FIG. 1 that the deck plank covers 15 are designed to run longitudinally along with the wooden deck planks 20, and to reside directly on the top surface thereof.

The deck plank covers 15 are preferably affixed to the wooden deck planks 20 by a "snap on" frictional adherence but any of several other means traditionally used in wooden deck construction, including nails and screws may also be used. Additionally, the deck plank covers 15 may be attached using an adhesive, or a combination of an adhesive and traditional mounting means.

Figure 2:
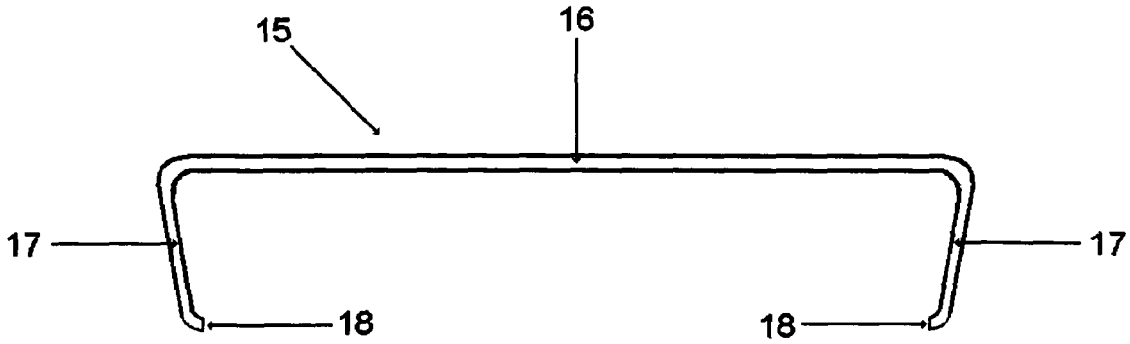
FIG. 2 is a cross-section of a preferred embodiment of the deck plank cover of the present invention.

A cross-section of a preferred embodiment of the deck plank cover 15 of the present invention can be seen by reference to FIG. 2. As mentioned above, the deck plank cover 15 should preferably be substantially the same width as the wooden deck plank to which it will be attached. The deck plank cover 15 may therefore be produced in various standard widths to mate to common lumber sizes. The deck plank cover 15 may also be produced in custom widths within reasonable manufacturing parameters.

As seen in FIG. 2, the present plank cover 15 is composed of a top portion 16 which covers the top exposed surface of the deck plank and two side portions 17 which are attached at opposite edges of the top portion 16. The side portions 17 are designed to cover the side surfaces of the decking plank. The side portions 17 are not connected perpendicular to the top portion 16, but are attached so and to angle inward toward each other. The inward angle of this configuration is chosen to allow for a snap tight fit to the deck plank, and to maintain such a snug frictional fit even when the wood to which the cover is attached shrinks upon aging. Each side portion 17 has attached thereto a wood engaging fillet 18 on the ends of the side portions 17 which are distant from the top portion 16. These fillets 18 are designed to grip the lower radial portions of the wooden plank for greater self adhesion and are attached to the side portions 17 at an angle which allows for maximum adhesion. The angle is approximately perpendicular to the plane of the side portions 17 respectively.

Figure 3:
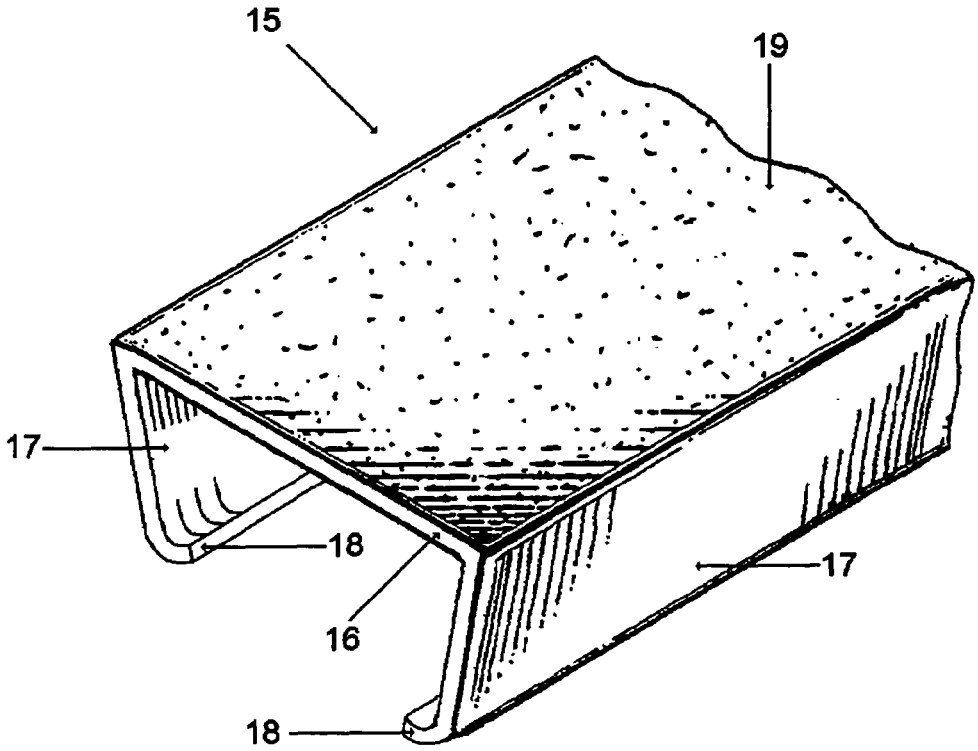
FIG. 3 is a three-dimensional view of a portion of a deck plank cover of the present invention.

FIG. 3 is a three dimensional view of a portion of a deck plank according to the present invention, from which can be seen the relationship of the fillet 18 to the side portions 17 and the top portion 16. A fillet 18 should always be provided along each longitudinal edge of the deck plank cover. Preferably, the fillets 18 run the entire length of the deck plank cover 15, but other embodiments can be envisioned wherein the fillets can be broken into segments that do not run the entire length of the plank cover. The fillets 18 contact the bottom radii of the wooden deck plank when the deck plank cover 15 is attached thereto. The fillets 18 along with the inward angle of the side portions 17 form the cohesion between the deck plank cover 15 and the wooden deck plank to which it is attached.

The top surface 19 of the deck plank cover 15 may employ texturing at various locations. In a preferred embodiment of the present invention, the texturing may run longitudinally along the length of the deck plank cover 15 and be configured to appear as wood grain. Many other textures and designs are possible, however.

Figure 4:
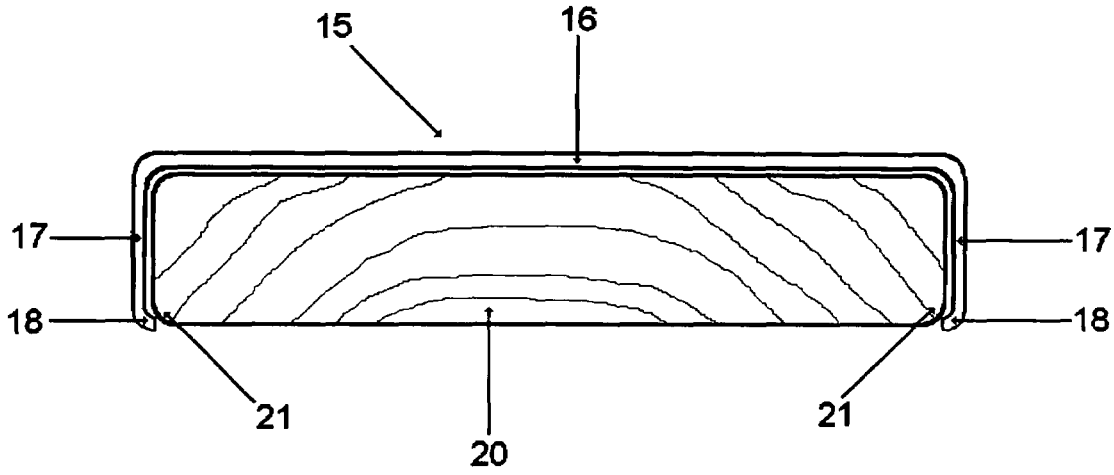
FIG. 4 is a cross-section of a deck plank cover of the present invention installed on a wooden deck plank.

Now referring to FIG. 4, a preferred embodiment of the deck plank cover 15 of the present invention can be seen affixed to a wooden deck plank 20. This figure shows how the plank cover 15 engages the wooden plank 20. Specifically shown is the way in which the fillet 18 engages the lower radial portions 21 of the wooden plank 20.

Figure 5:
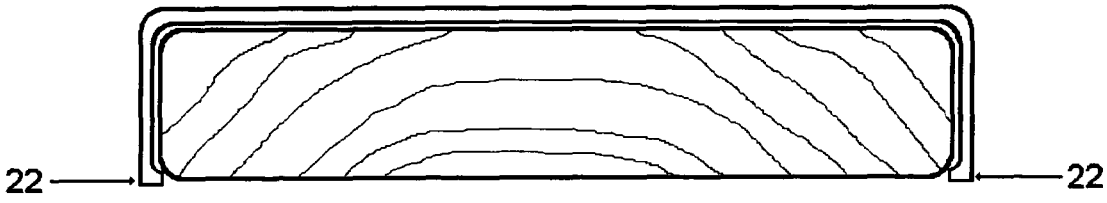
FIG. 5 is a cross-section of an alternative deck plank cover of the present invention installed on a wooden deck plank

FIG. 5 shows an alternative embodiment of the deck plank cover of the present invention in which the fillet also includes a drip edge 22. This drip edge helps to allow water to drip off of the cover in cases where the water may be apt to follow the curvature of the fillet and contact the wooded plank. The drip edge thus further protects the wooden deck planks.

The width of the deck plank cover 15 can be seen to be substantially the same as that of the wooden deck plank 20. This is important for several reasons. First, in one embodiment of the present invention, it is contemplated that the deck plank cover 15 will be utilized to cover a wooden deck plank 20 which is suffering from the initial stages of deterioration due to exposure to the elements. Employing a deck plank cover 15 with a width equivalent to that of the subjacent wooden deck plank 20, helps to ensure that rain and sunlight will be unable to contact substantially all of the top surface and sides of the wooden deck plank. Therefore, a majority of the wooden deck plank 20 will be sheltered from direct exposure to the elements. Preventing further contact with the elements will aid in preventing further deterioration of the wooden deck plank.

While one aspect of the present invention is to cover a wooden deck plank 20 that has begun to deteriorate, it should be realized that a deck plank that is rotted or otherwise structurally unsound must be replaced prior to the application of the deck plank cover 15. Replacement of a rotted deck plank is required, as application of the deck plank cover 15 may not provide the extra strength needed to make the deck plank structurally sound, particularly if deterioration continues. Therefore, the deck plank cover 15 of the present invention should only be applied to deck planks that are suffering from primarily visual deterioration, such as fading, cracking, or splintering, for example.

The deck plank cover of the present invention can be made from wood replacement materials such as homopolymers and copolymers of polyvinyl chloride (PVC), high density polyethylene (HDPE), polypropylene (PP), or a mixture of these polymers. Preferably the wood replacement material includes cellulose material to help create the appearance of real wood. The cellulose material may be in the form of cellulose fibers (e.g., wood flour and the like). A suitable wood replacement material composition and method are described in U.S. Pat. No. 5,516,472 entitled "Extruded Synthetic Wood Composition and Method for Making Same", the disclosure of which is hereby incorporated by reference. Typically, the deck plank cover of the present invention is produced by extrusion, but other methods of production are possible.

In a preferred embodiment of the invention, the deck plank cover may have a width equivalent to a standard 2×6 inch or a ¾×6 inch wooden board. It should be understood, however, that the deck plank cover may be designed to be equivalent to any of a number of common lumber widths, or to many other sizes and shapes without departing from the spirit and scope of the invention and may be used to cover existing plastic or composite, molded or extruded decks to change the color or texture of said decks.

Although the deck plank 15 of the present invention has been generally described above as applied to a wooden deck in a mildly deteriorated condition, such does not have to be the case. The deck plank cover 15 of the present invention may also be applied to decks with wooden deck planks in good condition, thereby eliminating the need for frequent cleaning and staining by obtaining the benefits of a plastic deck at less cost. Utilization of deck plank covers on newer wooden decks may serve to alleviate the need for the repeated application of chemical preservatives, such as stains and paints, and may retard the deterioration of the underlying deck planks by minimizing exposure to the elements.

Furthermore, it should be understood that the deck plank cover of the present invention may be produced in a variety of cross-sectional shapes and sizes in any of the materials mentioned above, and nothing in the foregoing description of the preferred embodiments should be construed to limit the deck plank cover of the present invention to any particular cross-sectional shape or size.

Although, the deck plank cover is preferably designed to simulate the look and color of wood, it may also be painted or stained. The moisture resistant properties of the material comprising the deck plank cover eliminates the splitting, splintering, decaying, discoloration and rotting common to wooden boards, and also serves to impede moisture from reaching the underlying wooden deck planks to which the deck plank covers are attached. Additionally, because the deck plank covers are moisture resistant, they are ideal for use in areas of high moisture, such as around pools and hot tubs.

It should be noted that the deck plank cover edges at the edges of the deck may be covered after installation by means of a trim strip or board running transverse to the wooden deck planks and deck plank covers.

The deck plank covers may be, if needed, attached to the wooden deck plank by screws, nails, adhesives and combinations thereof. If screws or nails are utilized for attachment, they may be driven through the deck plank cover just as they would if a wooden deck plank were used. The deck plank cover of the present invention may also be cut to size or shape as required.

The scope of the invention is not to be considered limited by the above disclosure, and modifications are possible without departing from the spirit of the invention as evidenced by the following claims.

What is claimed is:

1. A cover for covering a deck plank, said deck plank having a top surface, two side surfaces, and two lower radial portions, said cover comprising: a top portion which has a length and width and covers said top surface of said deck plank, said top portion having an outer surface which is remote from said deck plank, an inner surface which is adjacent said deck plank; two side portions, each of which has a length and a height and covers one of said side surfaces of said deck plank, said side portions attached to said top portion such that the length dimension of said top portion and said side portions coincide, both of said side portions projecting from said top portion in a direction generally opposite that of said outer surface of said top portion and at angles that deviate from perpendicular such that each of said side portions angles inward toward each other, the inward angle providing said cover with a frictional adhesion to said two side surfaces of said deck plank; and wood engaging fillets attached to the edges of said side portions which are distant from the top portion, said fillets curving radially inward toward each other and not extending parallel to said top portion beyond the radius of curvature of said fillets, thus said fillets are designed to grip only said lower radial portions of said deck plank thereby providing for additional frictional adhesion to said deck plank.

2. The deck plank cover of claim 1, wherein said cover is formed from a plastic/wood composite.

3. The deck plank cover of claim 1, wherein said cover is formed from polyethylene.

4. The deck plank cover of claim 1, wherein said cover is formed from polyvinyl chloride.

5. The deck plank cover of claim 1, wherein said cover is formed from polypropylene.

6. The deck plank cover of claim 1, wherein said deck plank cover is co-extruded from more than one plastic material.

7. The deck plank cover of claim 1, further comprising a texture on at least a portion of said outer surface of said top portion of said cover.

8. The deck plank cover of claim 7, wherein said texture has the purpose of increasing the coefficient of friction of said outer surface of said top portion of said deck plank cover.

9. The deck plank cover of claim 1, wherein said wood engaging fillets extend the entire length of said side portions.

10. The deck plank cover of claim 1, wherein said wood engaging fillets further include a drip edge designed to prevent water from contacting said deck plank.

11. In combination, a deck plank and a cover for covering said deck plank comprising: a deck plank, said plank having a top surface, a bottom surface and two side surfaces, said plank further having two upper and two lower radial edge portions; and a cover for covering said deck plank, said cover comprising: a top portion which has a length and width and covers said top surface of said deck plank, said top portion having an outer surface which is remote from said deck plank, an inner surface which is adjacent said deck plank; two side portions, each of which has a length and a height and covers one of said side surfaces of said deck plank, said side portions attached to said top portion such that the length dimension of said top portion and said side portions coincide, both of said side portions projecting from said top portion in a direction generally opposite that of said outer surface of said top portion and at angles that deviate from perpendicular such that each of said side portions angles inward toward each other, the inward angle providing said cover with a frictional adhesion to said two side surfaces of said deck plank; and wood engaging fillets attached to the edges of said side portions which are distant from the top portion, said fillets curving radially inward toward each other and gripping only said lower radial portions of said deck plank thereby providing for additional frictional adhesion to said deck plank.

12. The combination of claim 11, wherein said cover is formed from a plastic/wood composite.

13. The combination of claim 11, wherein said cover is formed from polyethylene.

14. The combination of claim 11, wherein said cover is formed from polyvinyl chloride.

15. The combination of claim 11, wherein said cover is formed from polypropylene.

16. The combination of claim 11, wherein said deck plank cover is co-extruded from more than one plastic material.

17. The combination of claim 11, further comprising a texture on at least a portion of said outer surface of said top portion of said cover.

18. The combination of claim 17, wherein said texture has the purpose of increasing the coefficient of friction of said outer surface of said top portion of said deck plank cover.

19. The combination of claim 11, wherein said wood engaging fillets extend the entire length of said side portions.

20. The combination of claim 11, wherein said wood engaging fillets further include a drip edge designed to prevent water from contacting said deck plank.

* * * * *